US010315452B2

(12) United States Patent
Bi et al.

(10) Patent No.: US 10,315,452 B2
(45) Date of Patent: Jun. 11, 2019

(54) FORENSIC FEATURE FOR SECURE DOCUMENTS

(71) Applicant: MorphoTrust USA, LLC, Billerica, MA (US)

(72) Inventors: Daoshen Bi, Boxborough, MA (US); Tung-Feng Yeh, Waltham, MA (US); Robert Jones, Andover, MA (US); J. Scott Carr, Carlisle, MA (US)

(73) Assignee: MorphoTrust USA, LLC, Billerica, MA (US)

( * ) Notice: Subject to any disclaimer, the term of this patent is extended or adjusted under 35 U.S.C. 154(b) by 338 days.

(21) Appl. No.: 15/140,952

(22) Filed: Apr. 28, 2016

(65) Prior Publication Data

US 2016/0236460 A1 Aug. 18, 2016

Related U.S. Application Data

(63) Continuation of application No. 11/460,207, filed on Jul. 26, 2006, now Pat. No. 9,399,363.

(Continued)

(51) Int. Cl.
*B42D 15/00* (2006.01)
*B42D 25/373* (2014.01)

(Continued)

(52) U.S. Cl.
CPC ..... *B42D 25/373* (2014.10); *B41F 11/02* (2013.01); *B41M 3/14* (2013.01); *B41M 5/502* (2013.01);

(Continued)

(58) Field of Classification Search
CPC ..... G06K 19/00; B32B 27/06; B32B 27/08; B32B 27/32; B32B 27/36
See application file for complete search history.

(56) References Cited

U.S. PATENT DOCUMENTS 5,334,573 A 8/1994 Schild
5,783,024 A 7/1998 Forkert (Continued)

FOREIGN PATENT DOCUMENTS

WO W003/105075 6/2002
WO WO 03105075 * 12/2003 ..... G06K 19/06

*Primary Examiner* — Anthony J Frost
(74) *Attorney, Agent, or Firm* — Fish & Richardson P.C.

(57) ABSTRACT

A forensic feature for a secure document comprises a base document layer and a covert material applied to the base document layer. The covert material includes a carrier and forensic material within the carrier. The forensic material includes a ratio of salts or oxides of metals, such as rare earth metals. The ratio is selected to correspond with a source of the document. The forensic material may be mixed into a coating or ink that is applied at predetermined locations on a secure document. The ratio is then measurable from metal ion signals of the salts or oxides. This ratio, or some metric derived from it, may be linked with information embedded elsewhere in the document to enable verification of the document. Another forensic document feature has a forensic metric that is measurable from a covert material in the document, and this forensic metric corresponds to a source of the document. A blocking layer applied over the covert material prevents access to the covert material such that at least partial destruction of the document is required to measure the forensic metric. The blocking layer may have a blocking property that blocks electromagnetic waves from activating the covert material, or blocks the electromagnetic waves from the covert material in response to the activating waves. The blocking layer is deconstructed to access the forensic feature, verify the document and perform forensic tracking.

20 Claims, 7 Drawing Sheets

Related U.S. Application Data

(60) Provisional application No. 60/702,725, filed on Jul. 26, 2005.

(51) Int. Cl.

| | |
|---|---|
| ***B42D 25/23*** | (2014.01) |
| ***B42D 25/318*** | (2014.01) |
| ***B42D 25/309*** | (2014.01) |
| ***B42D 25/313*** | (2014.01) |
| ***B41M 3/14*** | (2006.01) |
| ***B42D 25/00*** | (2014.01) |
| ***B42D 25/45*** | (2014.01) |
| ***B42D 25/333*** | (2014.01) |
| ***B41F 11/02*** | (2006.01) |
| ***B41M 5/50*** | (2006.01) |

(52) U.S. Cl.

CPC ..... *B42D 25/00* (2014.10); *B42D 25/23* (2014.10); *B42D 25/309* (2014.10); *B42D 25/313* (2014.10); *B42D 25/318* (2014.10); *B42D 25/333* (2014.10); *B42D 25/45* (2014.10); *B42D 2033/30* (2013.01); *B42D 2033/32* (2013.01)

(56) References Cited

U.S. PATENT DOCUMENTS

| | | | | |
|---|---|---|---|---|
| 6,003,581 | A | 12/1999 | Aihira | |
| 6,007,660 | A | 12/1999 | Forkert | |
| 6,066,594 | A | 5/2000 | Gunn | |
| 6,122,403 | A | 9/2000 | Rhoads | |
| 6,159,327 | A | 12/2000 | Forkert | |
| 6,283,188 | B1 | 9/2001 | Maynard et al. | |
| 6,308,991 | B1 | 10/2001 | Royer | |
| 6,614,914 | B1 | 9/2003 | Rhoads et al. | |
| 6,817,530 | B2 | 11/2004 | Labrec et al. | |
| 7,422,794 | B2 | 9/2008 | LaBrec et al. | |
| 8,144,016 | B2 | 3/2012 | Rancien | |
| 8,511,551 | B1 | 8/2013 | Foster | |
| 2002/0053597 | A1 | 5/2002 | Ehrhart et al. | |
| 2003/0003323 | A1* | 1/2003 | Murakami | B41M 3/144 428/690 |
| 2003/0006170 | A1* | 1/2003 | Lawandy | B07C 5/3412 209/3.3 |
| 2003/0231785 | A1 | 12/2003 | Rhoads et al. | |
| 2005/0067497 | A1 | 3/2005 | Jones et al. | |
| 2005/0109850 | A1* | 5/2005 | Jones | G06K 19/08 235/487 |
| 2005/0178841 | A1 | 8/2005 | Jones et al. | |
| 2005/0230960 | A1* | 10/2005 | Bilodeau | G09F 3/0292 283/75 |

* cited by examiner

FORENSIC FEATURE FOR SECURE DOCUMENTS

RELATED APPLICATION DATA

This patent application is a continuation of U.S. application Ser. No. 11/460,207, filed Jul. 26, 2006 which claims priority to U.S. Provisional Application No. 60/702,725, filed Jul. 26, 2005, both of which are hereby incorporated by reference.

TECHNICAL FIELD

The invention relates to secure documents and specifically features of secure documents that enable authentication, verification and forensic tracing to a particular source.

BACKGROUND

As counterfeiters become increasingly sophisticated in creating counterfeit secure documents (either from scratch or modifying valid documents), there is need for increasingly effective security measures to thwart them. One way to thwart counterfeiters is to insert features into documents that are difficult to reproduce. In some cases, these features are intended to be covert so that it is difficult for the counterfeiter to even identify their presence on the document. As an additional layer of security, these features should have a linking relationship with other features that interlock the features to increase the difficulty in accurately reproducing the relationship and show evidence of tampering when the relationship is broken. Finally, these features should include a means to provide forensic tracing capability so that analysis may be applied to trace the document to its source (e.g., manufacturer, printer, lot, operator, etc.). This enables detection and perhaps identification of an invalid source (or confirmation of a valid one) as well as useful information about the source for law enforcement.

The attributes identified above are needed for a broad spectrum of secure documents, and are particularly useful in identification documents. To provide context for forensic security features in identification documents, a description of these documents and methods for creating them follows below.

Secure Documents

Secure documents, and in particular, identification documents (hereafter "ID documents") play a critical role in today's society. One example of an ID document is an identification card ("ID card"). ID documents are used on a daily basis—to prove identity, to verify age, to access a secure area, to evidence driving privileges, to cash a check, and so on. Airplane passengers are required to show an ID document during check in, security screening and prior to boarding their flight. In addition, because we live in an ever-evolving cashless society, ID documents are used to make payments, access an automated teller machine (ATM), debit an account, or make a payment, etc.

For the purposes of this disclosure, ID documents are broadly defined herein, and include, e.g., credit cards, bank cards, phone cards, passports, driver's licenses, network access cards, employee badges, debit cards, security cards, smart cards (e.g., cards that include one more semiconductor chips, such as memory devices, microprocessors, and microcontrollers), contact cards, contactless cards, proximity cards (e.g., radio frequency (RFID) cards), visas, immigration documentation, national ID cards, citizenship cards, social security cards, security badges, certificates, identification cards or documents, voter registration cards, police ID cards, border crossing cards, legal instruments, security clearance badges and cards, gun permits, gift certificates or cards, membership cards or badges, etc.

Many types of identification documents carry certain items of information which relate to the identity of the bearer. Examples of such information include name, address, birth date, signature and photographic image; the cards or documents may in addition carry other variable data (i.e., data specific to a particular card or document, for example an employee number) and invariant data (i.e., data common to a large number of cards, for example the name of an employer). All of the cards described above will be generically referred to as "ID documents".

FIGS. 1 and 2 illustrate a front view and cross-sectional view (taken along the A-A line), respectively, of an identification (ID) document 10. In FIG. 1, the ID document 10 includes a photographic image 12, a bar code 14 (which may contain information specific to the person whose image appears in photographic image 12 and/or information that is the same from ID document to ID document), variable personal information 16, such as an address, signature, and/or birthdate, and biometric information 18 associated with the person whose image appears in photographic image 12 (e.g., a fingerprint, a facial image or template, or iris or retinal template), a magnetic stripe (which, for example, can be on a side of the ID document that is opposite the side with the photographic image), and various security features, such as a security pattern (for example, a printed pattern comprising a tightly printed pattern of finely divided printed and unprinted areas in close proximity to each other, such as a fine-line printed security pattern as is used in the printing of banknote paper, stock certificates, and the like).

Referring to FIG. 2, the ID document 10 comprises a pre-printed core 20 (also referred to as a substrate). In many applications, the core can be a light-colored, opaque material (e.g., TESLIN (available from PPG Industries), polyvinyl chloride (PVC) material, polyester, polycarbonate, etc.). The core 20 is laminated with a transparent material, such as clear polycarbonate, PVC or polyester material 22, which, by way of example, can be about 1-10 mil thick. The composite of the core 20 and clear laminate material 22 form a so-called "card blank" 25 that can be up to about 27 to 33 mils thick in accordance with ANSI standards. Information 26*a-c* is printed on the card blank 25 using a method such as Laser Xerography or Dye Diffusion Thermal Transfer ("D2T2") printing (e.g., as described in commonly assigned U.S. Pat. No. No. 6,066,594, which is incorporated by reference). The information 26*a-c* can, for example, comprise variable information (e.g., bearer information) and an indicium or indicia, such as the invariant or nonvarying information common to a large number of identification documents, for example the name and logo of the organization issuing the documents. The information 26*a-c* may be formed by any known process capable of forming the indicium on the specific core material used.

To facilitate printing of data on the card structure, an image receiving layer is applied to the card structure prior to printing for some printing technologies. One type of printing technology that uses an image receiving layer is D2T2 printing. U.S. Pat. Nos. 6,066,594 and 5,334,573 describe image receiving layers for D2T2 printing. A sheet or layer which is comprised of a polymer system of which at least one polymer is capable of receiving image-forming materials from a donor sheet upon the application of heat. The polymer system of the receiving sheet or layer is incompatible or immiscible with the polymer of the donor sheet at the receiving sheet/donor sheet interface to minimize adhesion between the donor sheet and the receiving sheet or layer during printing. The polymer system of the receiving sheet or layer can be substantially free from release agents, such as silicone-based oils, poly(organosiloxanes), fluorinated polymers, fluorine- or phosphate-containing surfactants, fatty acid surfactants and waxes. Binder materials for the dyes are immiscible with the polymer system of the image-receiving layer. The most common image-receiving layer polymers are polyester, polycaprolactone and poly(vinyl chloride). Processes for forming such image-receiving layers are also described in detail in these patents; in most cases, the polymer(s) used to form the image-receiving layer are dissolved in an organic solvent, such as methyl ethyl ketone, dichloromethane or chloroform, and the resultant solution coated on to the polymer layer using conventional coating apparatus, and the solvent evaporated to form the image-receiving layer. However, if desired the image-receiving layer can be applied to the polymer layer by extrusion casting, or by slot, gravure or other known coating methods.

Other forms of image receiving layers include image receiving layers for Xerographic printing and inkjet printing. These image receiving layers are applied to substrates such as paper or plastic and comprise materials that enhance reception of ink or dye to the substrate. Image receiving layers for Xerographic printing are sometimes referred to as "laser lock" or "toner lock."

To protect the information that is printed, an additional layer of transparent overlaminate 24 can be coupled to the card blank and printed information. Illustrative examples of usable materials for overlaminates include biaxially oriented polyester or other optically clear durable plastic film.

"Laminate" and "overlaminate" include, but are not limited to film and sheet products. Laminates used in documents include substantially transparent polymers. Examples of laminates used in documents include polyester, polycarbonate, polystyrene, cellulose ester, polyolefin, polysulfone, and polyamide. Laminates can be made using either an amorphous or biaxially oriented polymer. The laminate can comprise a plurality of separate laminate layers, for example a boundary layer and/or a film layer.

The degree of transparency of the laminate can, for example, be dictated by the information contained within the identification document, the particular colors and/or security features used, etc. The thickness of the laminate layers can vary and is typically about 1-20 mils. Lamination of any laminate layer(s) to any other layer of material (e.g., a core layer) can be accomplished using known lamination processes.

In ID documents, a laminate can provide a protective covering for the printed substrates and a level of protection against unauthorized tampering (e.g., a laminate would have to be removed to alter the printed information and then subsequently replaced after the alteration.). Various lamination processes are disclosed in assignee's U.S. Pat. Nos. 5,783,024, 6,007,660, 6,066,594, and 6,159,327. Other lamination processes are disclosed, e.g., in U.S. Pat. Nos. 6,283,188 and 6,003,581. A co-extruded lamination technology appears in U.S. patent application Ser. No. 10/692,463. Each of these U.S. Patents and applications is herein incorporated by reference.

The material(s) from which a laminate is made may be transparent, but need not be. Laminates can include synthetic resin-impregnated or coated base materials composed of successive layers of material, bonded together via heat, pressure, and/or adhesive. Laminates also includes security laminates, such as a transparent laminate material with proprietary security technology features and processes, which protects documents of value from counterfeiting, data alteration, photo substitution, duplication (including color photocopying), and simulation by use of materials and technologies that are commonly available. Laminates also can include thermosetting materials, such as epoxy.

Manufacture Environments

Commercial systems for issuing ID documents are of two main types, namely so-called "central" issue (CI), and so-called "on-the-spot" or "over-the-counter" (OTC) issue.

CI type ID documents are not immediately provided to the bearer, but are later issued to the bearer from a central location. For example, in one type of CI environment, a bearer reports to a document station where data is collected, the data are forwarded to a central location where the card is produced, and the card is forwarded to the bearer, often by mail. Another illustrative example of a CI assembling process occurs in a setting where a driver renews her license by mail or over the Internet, then receives a drivers license card through the mail.

A CI assembling process is more of a bulk process facility, where many cards are produced in a centralized facility, one after another. (For example, picture a setting where a driver passes a driving test, but then receives her license in the mail from a CI facility a short time later. The CI facility may process thousands of cards in a continuous manner.).

Centrally issued identification documents can be produced from digitally stored information and generally comprise an opaque core material (also referred to as "substrate"), such as paper or plastic, sandwiched between two or more layers of clear plastic laminate, such as polyester, to protect the aforementioned items of information from wear, exposure to the elements and tampering. U.S. Pat. No. 6,817,530, which is hereby incorporated by reference, describes approaches for manufacturing identification documents in a central issue process.

In contrast to CI identification documents, OTC identification documents are issued immediately to a bearer who is present at a document-issuing station. An OTC assembling process provides an ID document "on-the-spot". An example of an OTC assembling process is a Department of Motor Vehicles ("DMV") setting where a driver's license is issued to a person, on the spot, after a successful exam. In some instances, the very nature of the OTC assembling process results in small, sometimes compact, printing and card assemblers for printing the ID document.

OTC identification documents of the types mentioned above can take a number of forms, depending on cost and desired features. Some OTC ID documents comprise highly plasticized poly(vinyl chloride) or have a composite structure with polyester laminated to 0.5-4.0 mil (13-104.mu.m) poly(vinyl chloride) film on the outside of typical PVC or Composite cards, which provides a suitable image receiving layer for heat transferable dyes which form a photographic image, together with any variant or invariant data required for the identification of the bearer. These data are subsequently protected to varying degrees by clear, thin (0.125-0.250 mil, 3-6.mu.m) overlay patches applied at the printhead, holographic hot stamp foils (0.125-0.250 mil 3-6.mu.m}, or a clear polyester laminate (0.5-10 mil, 13-254.mu.m) supporting common security features. These last two types of protective foil or laminate sometimes are applied at a laminating station separate from the printhead. The choice of laminate dictates the degree of durability and security imparted to the system in protecting the image and other data. One form of overlay is referred to as a "transferred panel" or "0-panel." This type of panel refers to a panel in the print ribbon that is transferred to the document with the use of the printhead.

SUMMARY

The invention provides security features for secure documents, including features that enable verification and forensic tracking of the document to a source. The invention also provides methods for making the security features, document structures including these features, and methods for evaluating these features in suspect documents.

One aspect of the invention is a forensic feature for a document comprising a base document layer and a covert material applied to the base document layer. The covert material includes a carrier and forensic material within the carrier. The forensic material includes a ratio of salts or oxides of metals, such as rare earth metals. The ratio is selected to correspond with a source of the document. The forensic material may be mixed into a coating or ink that is applied at predetermined locations on a secure document. The ratio is then measurable from metal ion signals of the salts or oxides. This ratio, or some metric derived from it, may be linked with information embedded elsewhere in the document to enable verification of the document.

Another aspect of the invention is a forensic document feature where a forensic metric is measurable from the covert material, and the forensic metric corresponds to a source of the document. A blocking layer applied over the covert material prevents access to the covert material such that at least partial destruction of the document is required to measure the forensic metric. In one embodiment, the blocking layer has a blocking property that blocks electromagnetic waves from activating the covert material, or blocks the electromagnetic waves from the covert material in response to the activating waves.

Additional aspects of the invention include methods for making the forensic feature as well as the documents that include these features.

Finally, the invention includes methods for analyzing secure documents. In particular, one aspect of the invention is a method for analyzing a secure document comprising reading information steganographically embedded in the document, at least partially deconstructing the document to measure a forensic metric of a covert material in the document, and evaluating a relationship between the forensic metric and the information to authenticate the document.

BRIEF DESCRIPTION OF THE DRAWINGS

The advantages, features, and aspects of embodiments of the invention will be more fully understood in conjunction with the following detailed description and accompanying drawings, wherein.

Figure 1:
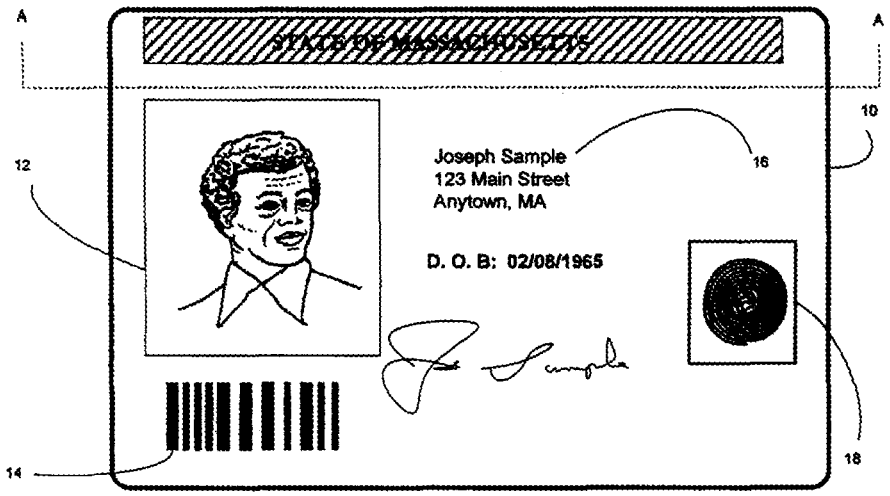
FIG. 1 is an illustrative example of an identification document.
Figure 2:
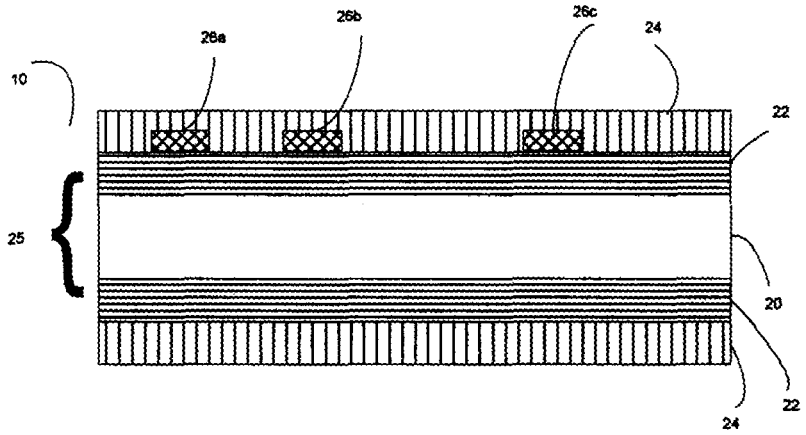
FIG. 2 is an illustrative cross section of the identification document of FIG. 1, taken along 10 the A-A line.

Of course, the drawings are not necessarily drawn to scale, with emphasis rather being placed upon illustrating the principles of the invention. In the drawings, like reference numbers indicate like elements or steps. Further, throughout this application, certain indicia, information, identification documents, data, etc., may be shown as having a particular cross sectional shape (e.g., rectangular) but that is provided by way of example and illustration only and is not limiting, nor is the shape intended to represent the actual resultant cross sectional shape that occurs during manufacturing of identification documents.

DETAILED DESCRIPTION

Figure 3:
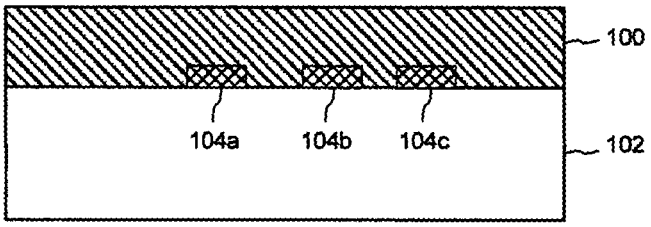
FIG. 3 is a diagram illustrating a cross section of a document structure including one example of a forensic feature.

FIG. 3 is a diagram illustrating a cross section of an identification document including a covert material (e.g., 104*a-c*) between document layers 100 and 102. The covert material comprises a forensic material, such as a predetermined ratio of salts or oxides of metals (preferably rare earth metals). Document layers can be made of a variety of materials used in secure documents. In our implementations, the covert material is applied to a base layer 102 and one or more additional layers 100 are then applied over the covert material. For identification documents, the base layer is typically a core or substrate of the document, and the additional layers typically comprise laminates or coatings. Our implementations are particularly suited for multi-layer ID document architectures (e.g., TESLIN-core, PVC-core or Polycarbonate-core, multi-layered ID documents), but a forensic material comprising a unique ratio of salts or oxides could be used in other secure document structures.

We use salts or oxides of unique (e.g., rare earth metals) to provide a unique forensic feature in both CI and OTC ID cards. The feature is such that destruction of the card or, at least, a portion of the card is necessary to authenticate and validate the card as genuine. In other words, the presence of the feature cannot be detected by even knowledgeable professionals without tearing the card open in the correct location or by destroying the card (or portions of the card) by combustion.

Additionally, more than one salt or oxide can be used so that the ratio of the individual metal ion signals can be used to verify authenticity. Analytical testing such as AE (atomic emission) or X-Ray fluorescence (ESCA) or other suitable techniques for which these metal ion compounds have distinctive signals are used to measure a forensic metric corresponding to the ratio. The use of combinations of salts or oxides offers up several advantages: 1) One does not have to be concerned with the amount of material laid down opening up the manufacturing/operational window considerably; 2) Matching the color or the base stock (TESLIN for example in our CI or OTC cards) becomes a much easier task allowing for the printing via offset or screen on any location (front or back) of the card; 3) Ratios can be chosen such that they are specific to a given issuer (e.g., a State or country) or device; and finally, 4) Multiple salts or oxides can be used to generate a forensic tracking scheme using specific ratios of compounds to define a given lot of material or day of manufacture. For example, a 4/2/1 ratio of Erbium oxide to Lanthanum oxide to Yttrium oxide could be used to indicate lot #23 for the State of Wisconsin and then a 4/1/1 ratio could be used to indicate lot #24 for the State of Illinois and so on. More specific identification of particular documents can be achieved using unique patterns and/or locations of covert material including the forensic material.

In our card implementations, the requirements of the salts or oxides chosen for government issued ID cards are: 1) They are stable over time and in a wide range of temperature and humidity conditions; 2) They can be milled or dissolved into a carrier such as offset, litho, gravure, or flexo inks and that they then present viable printing ink materials; 3) They have essentially the same color (white) if they are to be applied to the base stock in an invisible fashion; and 4) If not white, then they allow formulation into a known colored ink with standard vehicles and that the resultant ink is a commercially viable one.

Though not necessary, these materials can be printed in a known pattern. Preferably, the covert material comprising the salts or oxides is applied at a particular, predetermined location on the card—front or back. The back is preferred since there is less chance for either contamination of other printing mechanisms or interference with other printing processes or card function.

Figure 4:
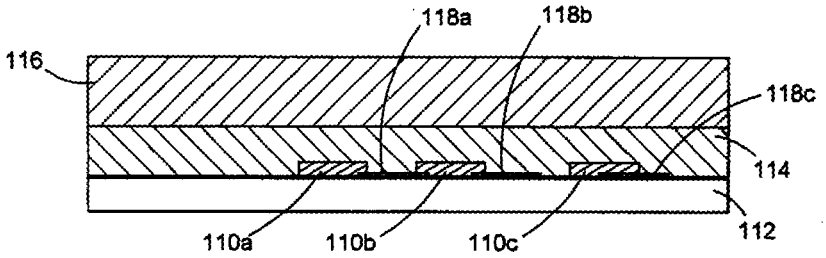
FIG. 4 is a diagram illustrating a cross section of a document structure with an alternative example of a forensic feature.

FIG. 4 is a diagram illustrating a cross section of a document structure with an alternative example of a forensic feature. In this example, a covert material 110 is applied to a base document layer 112. The covert material provides a forensic metric, which is measurable from the covert material for authentication and forensic tracking of the document to a source (e.g., issuer, time of manufacture and lot). A blocking layer 114, which partially or fully covers the covert material 110, is applied over the covert material. The blocking layer prevents access to the covert material such that at least partial destruction of the document is required to measure the forensic metric.

Another protective layer 116 is applied over the blocking layer in this example. In ID document applications, this protective layer 116 may comprise a laminate and the base document layer 112 may comprise a core of the ID document, with the blocking and covert materials comprising layers of printed material.

In one implementation, the covert material is activated by electromagnetic waves in a first band, and responds with electromagnetic waves in a second band. For example, the covert material becomes activated when exposed to electromagnetic radiation in the first band. It then responds by transmitting, emitting, reflecting or fluorescing electromagnetic waves in a second band, which may or may not differ from the first band. The blocking layer comprises a blocking property that blocks the first band, the second band, or both the first and second bands.

In one particular embodiment, the blocking layer allows the waves of the activating band to substantially pass through to the covert material, yet it blocks the response from the covert material. In another embodiment, the block layer substantially blocks the waves of the activating band such that the covert material is not activated so long as the blocking layer remains in tact on the document. In both cases, the blocking layer makes the covert material undetectable without destruction of the document.

In one specific embodiment, the covert material comprises a covert ink such as an IR ink. For example, an IR ink pattern is printed on the core of an ID document via offset printing. The blocking layer either blocks the waves needed to activate the IR material (e.g., cause it to fluoresce) or it allows these waves, yet blocks the response from the IR material, such as blocking the waves from the fluorescing of the IR material (which may be in a different band from the activating band). The blocking of waves in or out of the blocking layer may be achieved by putting a material in the blocking layer that absorbs light in a particular band. For example, a carbon pigment may be used to block both the activating band and the response that would otherwise result from the covert material in the absence of the blocking layer. This carbon pigment may be printed over the covert material, or contained in a coating, laminate, film or other layer applied over the covert material.

Referring again to FIG. 4, the covert material 11O*a-c* may be intermingled and interlocked with other material 118*a-c* printed on the document. Both the covert material 110 and other material 118 may be variable or fixed information. Variable information includes personal information unique to the bearer, such as photo, biometric, name, birth date, address, document number. Fixed information includes information that is common to at least a batch or lot of documents, such as issuer seal or graphic, issuer name, etc. The interlocking may be a physical interlocking: physical connection between items 110 and 118. The interlocking may also be a logical interlocking of data: the information conveyed in items 110 and 118 is the same or related through a predetermined relationship. This relationship may be a mathematical relationship, such as a hash, or a spatial relationship, such as a unique pattern comprised of the location of both items 110 and 118. Finally, the interlocking may be both physical and logical.

The interlocking relationship may be conveyed through the use of machine readable data carriers (chip, RFID, magnetic strip, bar code, optical readable media, digital watermark, etc.). Items 110 and 118 themselves may be conveyed in carriers, such as inks or other media, which constitute machine readable data carriers. The machine readable data carriers may be used to: 1. store data used to logically interlock security elements on the document; 2. store the forensic metric of the covert material, such as a pattern, hash, ratio of materials, location, or other measurable attribute of the covert material; 3. store a key or other information necessary to locate, decrypt or decode the forensic metric of the covert material. In one implementation, inks used to print visible or covert inks, including the inks used to convey the covert forensic material are used to print images that include steganographically embedded information, such as digital watermarks. These digital watermarks, in turn, are used to store the information to identify, locate and verify other security features, including the forensic feature embedded in the document.

Figure 5:
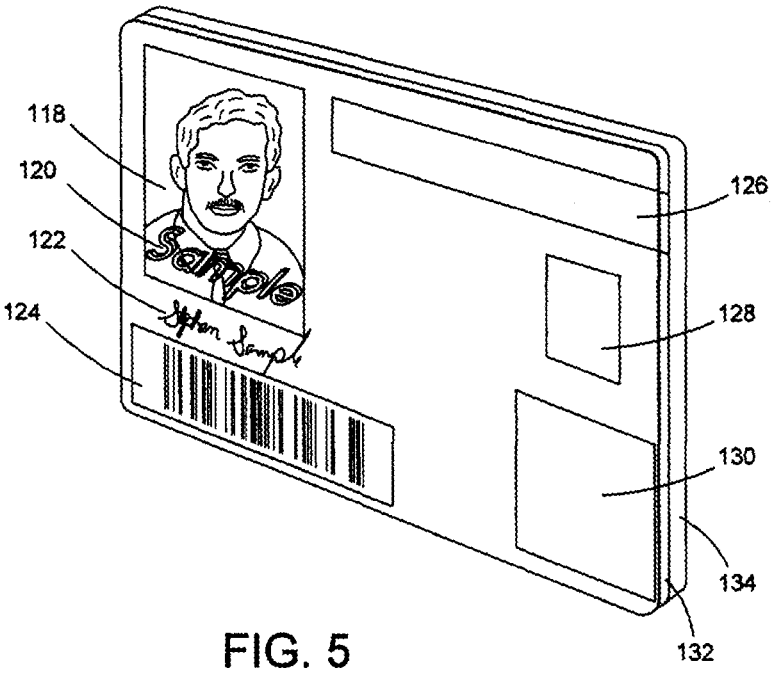
FIG. 5 is a diagram illustrating an example of identification document with forensic features embedded at one or more locations on the document, including areas with fixed and variable information.

FIG. 5 is a diagram illustrating an example of identification document with forensic features embedded at one or more locations on the document, including areas with fixed and variable information. The document includes a variety of features such as a photo of the bearer 118, security feature 120 physically interlocked in the photo 118, image of signature 122, bar code 124, printed issuer and bearer information 126, security feature 128 (ghost image of bearer), and other information 130, such as a biometric image, chip, optical media, etc. These various features may reside at one or more of the document layers 132, 134. The covert material may be printed in one or more of these areas so as to be interlocked with these features. The covert material may also be embedded in different document layers 132, 134. Finally, the covert material may have attributes, such as a pattern, forensic metric, etc. that are stored on the machine readable data carriers on the document. The machine readable information may then be read and used to locate, decode, decrypt and/or verify the validity of the forensic feature in the covert material.

Figure 6:
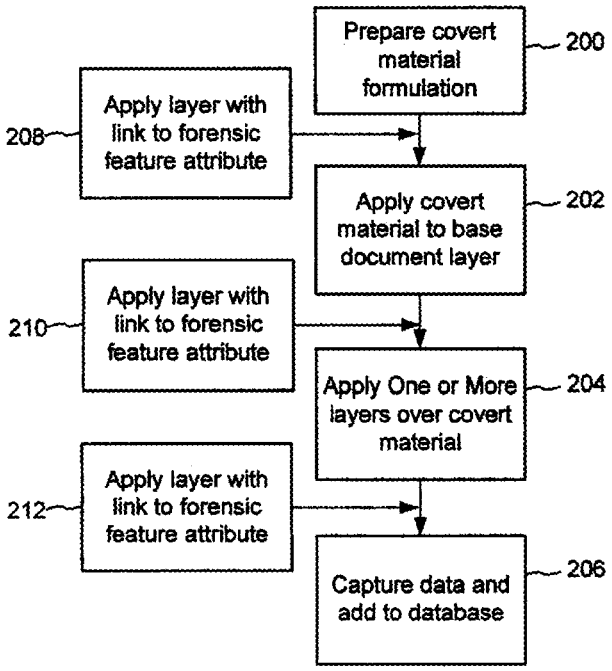
FIG. 6 is a flow diagram illustrating a method for making a document structure including a forensic feature.

FIG. 6 is a flow diagram illustrating a method for making a document structure including a forensic feature. The covert material formulation is prepared, such as by mixing a carrier with forensic material, such as mixing an ink with particular ratio of compounds or covert pigments (200). This covert material is then applied to the base document layer, which can vary depending on the document architecture at issue (e.g., a core, laminate, film, etc.) (202). Next, one or more layers are applied over the covert material (204). Finally, forensic data in the document is captured and stored in a database to maintain the association between the document and forensic data that it includes.

The left hand side of FIG. 6 shows that the document layers including a link to the forensic feature may be applied to the document at various stages in document production, including before, during or after application of the covert material (208-212). For example, each of these layers, including the layer that includes the covert material itself, may include a machine readable data carrier that stores attributes of the forensic feature, such as the forensic metric (ratio of materials, pattern of covert material, etc.). The link need not be implemented with a machine readable data carrier; it may be a human verifiable relationship as well. However, machine readable data carriers facilitate machine verification, as well as the use of machine computing to implement encryption of the forensic metric and forensic data, secure hashing to create unique relationships between the forensic feature and its hash stored elsewhere on the document or database, and steganographic techniques for hiding forensic metrics and data within other data on the document. These techniques enable complex relationships among the data carriers and data stored in the database that are used to verify authenticity with high degree of certainty and detect document tampering by identifying where these relationships have been broken (e.g., hashes do not match, data cannot be decrypted into usable form because key decoded form document is invalid, forensic feature has invalid pattern in invalid location, forensic feature absent in location specified within encrypted data carrier, etc.). One example is to derive data from the forensic feature, such as the forensic metric (including a hash of the metric), scramble this data (encrypting with one or more private or public keys), encode it in a data message (using error correction coding), and steganographically embed this data message on the document. This steganographic embedding may take the form of a digital watermark embedded in an image printed on the document by subtly altering that image as well as embedded in data stored on a machine readable data carrier on the document (e.g., embedded in image or other biometric data in chip, bar code, or optical memory element). Methods for embedding digital watermarks are described in U.S. Pat. Nos. 6,122,403 and 6,614,914, which are hereby incorporated by reference.

Figure 7:
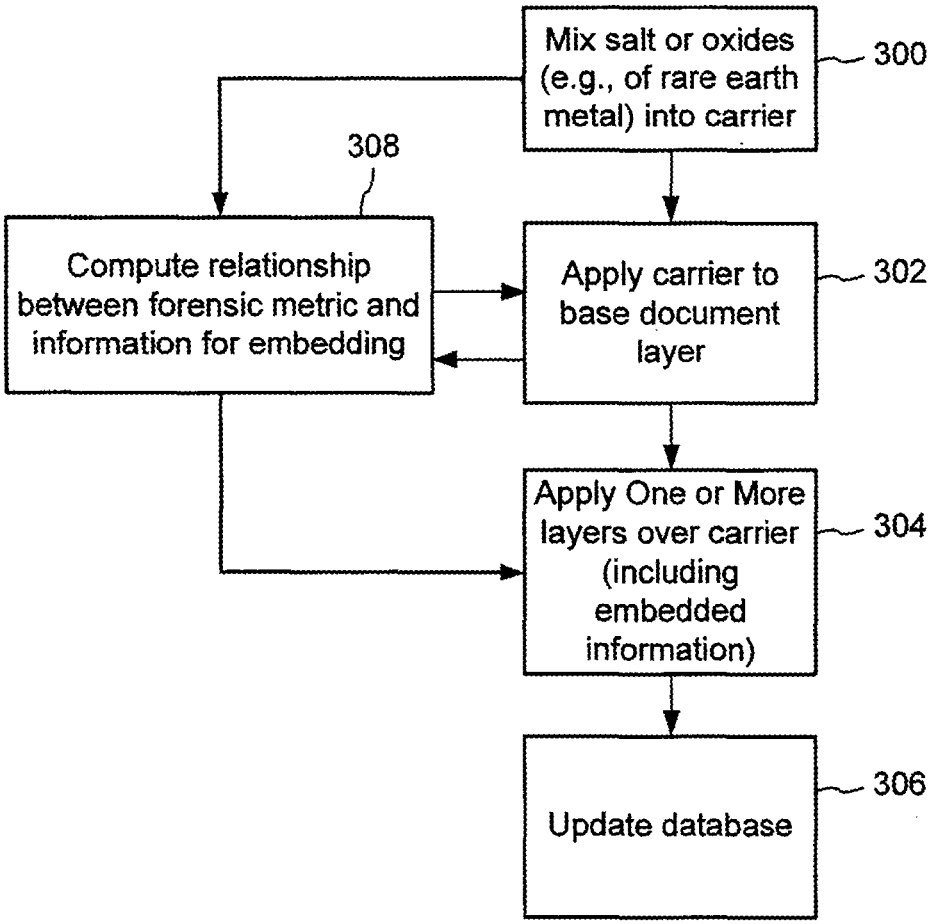
FIG. 7 is a flow diagram illustrating a method of making a document structure having forensic feature comprised of a ratio of salts or oxides.

FIG. 7 is a flow diagram illustrating a method of making a document structure having forensic feature comprised of a ratio of salts or oxides. The method includes mixing the salt or oxide of rare earth metal into a carrier, such as an ink or coating (300). The carrier is then applied to the document by printing or coating (302). This printing operation may be adapted for printing and coating machines used in either CI or OTC ID document production. For example, it may include printing with offset, litho, or gravure equipment. Alternatively, the carrier may comprise a thermal transfer printer panel (such as a panel used in D2T2 printer ribbons). Alternatively, the carrier may comprise an ink used in ink jet printing or a toner for use in Xerographic printing. One or more layers may then be applied over the carrier of the forensic material (304). Finally, the forensic data conveyed in the forensic material, such as the ratio of salts/oxides, is added to the database, which stores data about the document (306). This data may also include information about the equipment used to print the equipment, the issuer or operator, the issuer location, the time and date of manufacture or issue, etc. Preferably, data referring back to this database entry, such as a document identification number, is embedded, printed and/or otherwise stored on the document.

Block 308 illustrates that the process includes computing a relationship between the forensic metric and information to be embedded on the document. In one implementation, this relationship means that the metric is embedded elsewhere or some mathematical derivative of it is embedded elsewhere on the document. This relationship may be encoded in a pattern and embedded on the document. In some cases, it is preferable to apply the forensic material, measure the metric, and then encode this metric in the database and/or document. This enables any changes to the metric due to application of the metric to the document to be taken into account before recording it. Alternatively, if the forensic metric is expected not to change, it may be embedded on the document before the forensic material is applied to the document.

Figure 8:
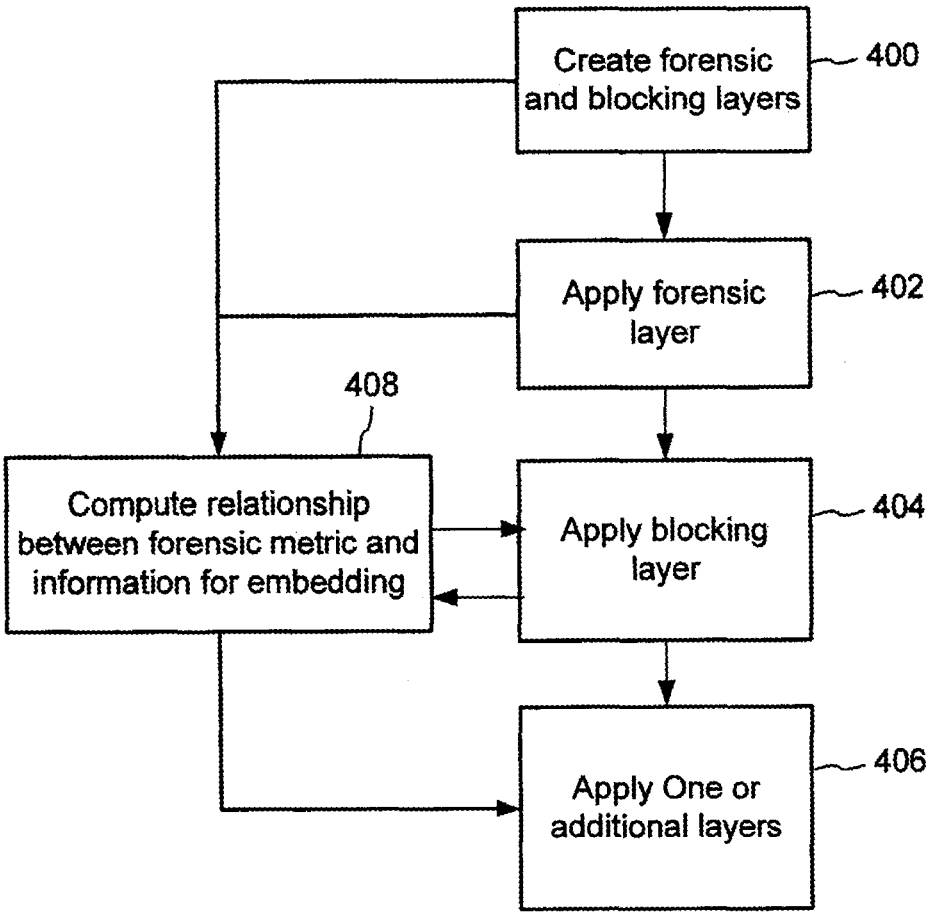
FIG. 8 is a flow diagram illustrating a method of making a document structure having a forensic layer and a blocking layer, where the blocking layer prevents access to the forensic layer.

FIG. 8 is a flow diagram illustrating a method of making a document structure having a forensic layer and a blocking layer, where the blocking layer prevents access to the forensic layer. The forensic layer comprises a layer with forensic material, such as a ratio of rare compounds or covert material. The blocking layer comprise a material used to prevent access to the forensic material, such that deconstruction of the document is required to access the forensic material. The method creates the forensic and blocking layers (400), applies the forensic layer (402) and applies the blocking layer (404). In particular implementations, the blocking and forensic layers may be created and applied at different times, such as at the time of creating ID card stock and at the time of personalizing the ID card stock with information of an applicant. An additional layer may also be added (406) to cover the blocking layer, such as a protective overlaminate or hard coat (e.g., a UV or EB curable hard coat). As discussed in connection with FIG. 7, the relationship between a forensic metric and the information embedded within one or more layers of the document may be created and used at various stages in the process.

Figure 9:
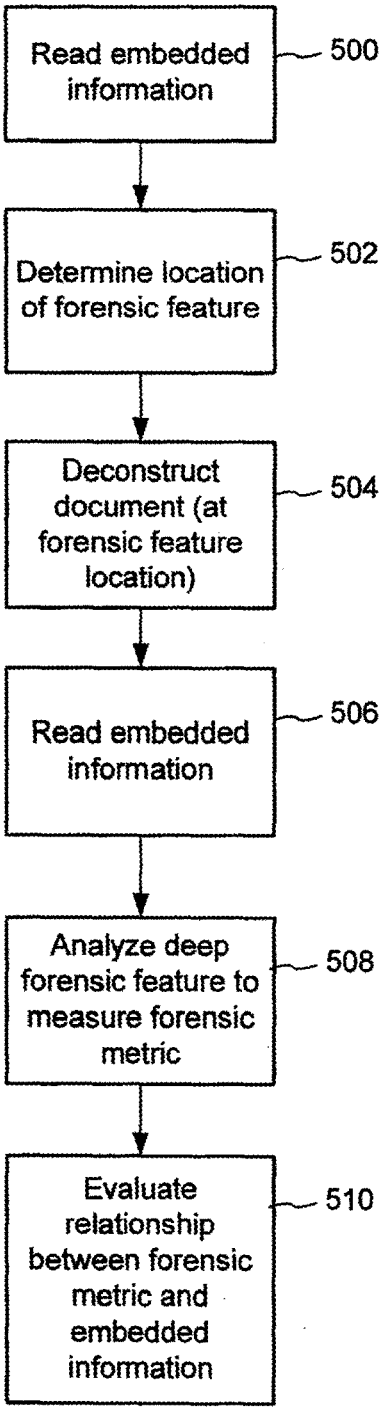
FIG. 9 is a flow diagram illustrating a method for evaluating a forensic feature for document authentication and forensic tracking.

FIG. 9 is a flow diagram illustrating a method for evaluating a forensic feature for document authentication and forensic tracking. The method begins by reading information embedded in the document (500). For example, the document is scanned and information is extracted from machine readable data carriers. Preferably, information related to the forensic feature is steganographically embedded in the document through the use of a digital watermark as described previously. In this case, the reading may include scanning an image, detecting the digital watermark in the image, decoding the message payload of the watermark (e.g., using one or more public or private watermark decoding keys), and decrypting the message (e.g., using one or more private or public encryption keys). The watermark message may include information identifying the location of the forensic feature, or may provide an index to a database that provides information about the document, including the expected forensic information. This or other predetermined information is used to determine the location of the forensic feature (502). The document is then deconstructed, and preferably, it is deconstructed at the forensic feature location (504). At this stage, an additional reading of embedded information may be performed after one or more layers (e.g., layers blocked by the blocking layer) have been exposed through the deconstruction process (506). This information may include information used to verify the forensic feature as described previously.

Next the forensic feature is analyzed to measure the forensic feature (508). This may include an analysis of metal ion signals to measure the ratio of compounds. It may also include analyzing covert pigments revealed after deconstruction of a blocking layer. The covert pigment may be designed to have a unique signature, or convey a unique pattern as a forensic metric. The validity of the document is checked by evaluating the relationship between this measured metric and the metric stored in the embedded information on the document and/or information in a database. Further, the forensic metric itself conveys data as to the source of the document in cases where the metric is specifically chosen to correspond to the source (lot, time of manufacture, issuer, issuer location, device of manufacture, etc.). To check the source, the metric may be looked up in a database to find the source information corresponding the metric measured in the document.

Concluding Remarks

Having described and illustrated the principles of the technology with reference to specific implementations, it will be recognized that the technology can be implemented in many other, different, forms, and in many different environments.

The technology disclosed herein can be used in combination with other technologies. Also, instead of ID documents, the inventive techniques can be employed with product tags, product packaging, labels, business cards, bags, charts, smart cards, maps, labels, etc. The term ID document is broadly defined herein to include these tags, maps, labels, packaging, cards, etc.

It should be understood that, in the Figures of this application, in some instances, a plurality of method steps may be shown as illustrative of a particular method, and a single method step may be shown as illustrative of a plurality of a particular method steps. It should be understood that showing a plurality of a particular element or step is not intended to imply that a system or method implemented in accordance with the invention must comprise more than one of that element or step, nor is it intended by illustrating a single element or step that the invention is limited to embodiments having only a single one of that respective elements or steps. In addition, the total number of elements or steps shown for a particular system element or method is not intended to be limiting; those skilled in the art will recognize that the number of a particular system element or method steps can, in some instances, be selected to accommodate the particular user needs.

To provide a comprehensive disclosure without unduly lengthening the specification, applicants hereby incorporate by reference each of the U.S. patent documents referenced above.

The technology and solutions disclosed herein have made use of elements and techniques known from the cited documents. Other elements and techniques from the cited documents can similarly be combined to yield further implementations within the scope of the present invention.

Thus, the exemplary embodiments are only selected samples of the solutions available by combining the teachings referenced above. The other solutions necessarily are not exhaustively described herein, but are fairly within the understanding of an artisan given the foregoing disclosure and familiarity with the cited art. The particular combinations of elements and features in the above-detailed embodiments are exemplary only; the interchanging and substitution of these teachings with other teachings in this and the incorporated-by-reference patent documents are also expressly contemplated.

In describing the embodiments of the invention illustrated in the figures, specific terminology is used for the sake of clarity. However, the invention is not limited to the specific terms so selected, and each specific term at least includes all technical and functional equivalents that operate in a similar manner to accomplish a similar purpose.

What is claimed is:

1. A method of making a forensic feature for a document comprising:

providing a base document layer of a document;

applying a covert material to a portion of the base document layer, the covert material including a carrier and a mixture of forensic materials within the carrier, the mixture of forensic materials including a ratio of materials selected from the group comprising a salt and an oxide of metal;

applying a blocking layer over the covert material, the blocking layer obscuring the covert material on the base document layer and preventing access to the covert material without damaging the blocking layer; and applying a machine readable data carrier to the document, the machine readable carrier storing data indicating at least one forensic metric of the covert material.

2. The method of claim 1 wherein the blocking layer prevents access to the mixture of forensic materials such that at least partial destruction of the blocking layer by tearing or combustion is required to measure the ratio.

3. The method of claim 1 further comprising computing a metric related to the ratio and embedding the metric in a layer in the document.

4. The method of claim 3 further comprising embedding the metric in a layer that includes the covert material.

5. The method of claim 3 further comprising steganographically embedding the metric in the document.

6. The method of claim 3 further comprising embedding a digital watermark carrying the metric in an image on the document.

7. The method of claim 1 wherein the covert material is printed on the base layer.

8. An identification document comprising:

a first document layer;

a covert material applied to a portion of the first document layer, the covert material including a carrier and a mixture of forensic materials within the carrier, the mixture of forensic materials including a ratio of materials selected from the group comprising a salt and an oxide of metal;

a blocking layer applied over the covert material, the blocking layer obscuring the covert material and preventing access to the covert material without damaging the blocking layer; and a machine readable data carrier applied to the identification document, the machine readable carrier storing data indicating at least one forensic metric of the covert material.

9. The identification document of claim 8 wherein the machine readable data carrier is steganographically embedded in the document.

10. The identification document of claim 9 wherein the machine readable data carrier is a digital watermark embedded in information printed on the document.

11. The identification document of claim 8 wherein the data indicating at least one forensic metric of the covert material includes data indicating a forensic metric mathematically related to the ratio.

12. The identification document of claim 8 wherein the data indicating at least one forensic metric of the covert material includes data identifying a location of the covert materials on the first document layer.

13. The identification document of claim 8 wherein the covert material is the same color as the first document layer such that the covert material is not visible.

14. The identification document of claim 8 wherein the mixture of forensic materials including the salt and the oxide of metal is white in color such that it can be mixed with a colored ink without affecting the color of the ink.

15. The identification document of claim 8 wherein the data indicating at least one forensic metric of the covert material includes a key for decrypting the forensic metric of the covert material.

16. The identification document of claim 8 wherein the covert material comprises a coating.

17. The identification document of claim 8 wherein the covert material is printed on the first document layer.

18. The identification document of claim 8 wherein the ratio is measurable from metal ions of the mixture of forensic materials.

19. The identification document of claim 8 wherein the blocking layer prevents access to the mixture of forensic materials such that at least partial destruction of the blocking layer by combustion is required to measure the ratio.

20. An identification document comprising:

a first document layer;

a covert material applied at a location on the first document layer, the covert material including a carrier and a mixture of forensic materials within the carrier, the mixture of forensic materials including a ratio of materials;

a blocking layer applied over the covert material, the blocking layer obscuring the covert material; and a machine readable data carrier, different from the covert material, applied to the identification document, the machine readable carrier storing data indicating the location of the covert material on the first document layer.

* * * * *